US008919363B1

(12) United States Patent
Johnson

(10) Patent No.: US 8,919,363 B1
(45) Date of Patent: Dec. 30, 2014

(54) COLLAPSIBLE STACKING RACK

(76) Inventor: Curtis Laroy Johnson, Greenbrier, AR (US)

( * ) Notice: Subject to any disclaimer, the term of this patent is extended or adjusted under 35 U.S.C. 154(b) by 271 days.

(21) Appl. No.: 13/302,869

(22) Filed: Nov. 22, 2011

Related U.S. Application Data

(60) Provisional application No. 61/458,399, filed on Nov. 23, 2010.

(51) Int. Cl.
*E04H 15/44* (2006.01)

(52) U.S. Cl.
USPC ..... 135/128; 135/160; 135/905

(58) Field of Classification Search
USPC ..... 135/121, 128, 158, 160, 905; 211/189, 211/191, 188, 194, 195, 175; 52/79.5, 52/79.12, 90.1, 653.1, 93.1; 446/478, 124
See application file for complete search history.

(56) References Cited

U.S. PATENT DOCUMENTS

| | | | | | |
|---|---|---|---|---|---|
| 681,301 | A * | 8/1901 | Corson | 52/63 |
| 732,037 | A * | 6/1903 | Best | 294/167 |
| 2,835,262 | A * | 5/1958 | Collins | 135/121 |
| 2,845,078 | A * | 7/1958 | Singleton | 135/121 |
| 3,662,502 | A * | 5/1972 | Wright | 52/93.2 |
| 4,261,470 | A | 4/1981 | Dolan | |
| 4,333,574 | A | 6/1982 | Christy, Sr. | |
| 4,616,757 | A * | 10/1986 | Hobson | 211/189 |
| 4,726,157 | A * | 2/1988 | Hult et al. | 52/79.5 |
| 5,185,972 | A * | 2/1993 | Markiewicz | 52/63 |
| 5,289,665 | A | 3/1994 | Higgins | |
| 5,377,851 | A | 1/1995 | Asano et al. | |
| 5,845,794 | A * | 12/1998 | Highsmith | 211/189 |
| 6,298,999 | B1 | 10/2001 | Bellman | |
| 7,334,692 | B2 | 2/2008 | Black | |
| 2004/0007550 | A1 * | 1/2004 | Leeman et al. | 211/189 |

* cited by examiner

*Primary Examiner* — David R Dunn
*Assistant Examiner* — Danielle Jackson

(57) ABSTRACT

A collapsible stacking rack is constructed of end assemblies and friction-fit crossmembers. The crossmembers feature slots that engage in slots formed between the vertical members of the end assembles and turn-ups on the ends of horizontal members of the end assemblies. As a result, a box-like construction results from simply fitting the crossmembers into place, resulting in a strong rack that may be easily disassembled for storage or transport without tools or connectors. An optional roof formed of truss assemblies may be fitted into place and connected to the side assemblies by means of sleeves. Such roof is held in place by gravity, such that it may be easily removed or fitted into place as desired. A pliable fabric material is fitted over the truss assemblies to protect material within the stacking rack.

11 Claims, 4 Drawing Sheets

COLLAPSIBLE STACKING RACK

CROSS-REFERENCE TO RELATED APPLICATIONS

This application claims the benefit of prior U.S. provisional patent application No. 61/458,399, filed on Nov. 23, 2010, and entitled "Friction Lock Stacking Rack." Such application is incorporated herein by reference in its entirety.

STATEMENT REGARDING FEDERALLY SPONSORED RESEARCH OR DEVELOPMENT

Not applicable.

BACKGROUND OF THE INVENTION

Numerous types of stacking racks are known in the art. The art includes numerous methods by which such racks may be assembled together in a rigid fashion. U.S. Pat. Nos. 4,261,470, 7,334,692, and 5,289,665 teach exemplary collapsible stacking racks. Nevertheless, none of the prior art stacking racks provide a desired combination of strength, simplicity, low cost, and ease of assembly and disassembly. The present invention overcomes the limitations of the prior art stacking racks, and achieves these desired objectives, as explained following.

References mentioned in this background section are not admitted to be prior art with respect to the present invention.

BRIEF SUMMARY OF THE INVENTION

The present invention is directed to a collapsible stacking rack that assembles and disassembles using a friction-fit mechanism. At each level of the rack, the horizontal members on the end assemblies have upturned ends such that, where they connect with the vertical members of the end assemblies, they form a lock slot that can receive a matching slot on the transverse crossmembers. The result is a friction-fit locking system that provides a secure support for the rack even when heavy items are placed on the rack, but which can be easily disassembled and reassembled as desired for storage or transport. The stacking rack is sufficiently strong to hold heavy, long items, such as lumber and metal piping or tubing. Nevertheless, it may be easily and quickly assembled or disassembled by a team of only two men due to its design as explained above. Its simple design and low cost of construction are also desirable features. In various embodiments an optional roof, which may for example be a gable or simple slant roof, is formed by trusses that fit together with the vertical members of the rack via connecting sleeves. These embodiments may employ a canvas roof that is stretched across the trusses and connected at eyelets.

In one aspect, the invention is directed to a collapsible stacking rack, comprising a plurality of end assemblies, wherein each of the plurality of end assemblies are arranged in a parallel fashion with respect to each other, and wherein each of the plurality of end assemblies comprises a plurality of vertical members and at least one horizontal turn-up member, wherein each of the plurality of vertical members are arranged parallel to each other, and the at least one turn-up member is rigidly attached to the plurality of vertical members and lies perpendicularly to each of the plurality of vertical members; and at least one crossmember comprising a width, wherein the crossmember is positioned transverse to the plurality of end assemblies and the at least one crossmember comprises a plurality of crossmember slots, wherein the at least one horizontal turn-up member comprises a turn-up section at an end of the at least one horizontal turn-up member wherein a distance between an outside edge of a nearest one of the plurality of vertical members and an inside edge of the turn-up section at the end of the at least one horizontal turn-up member defines a turn-up space comprising a turn-up space width at least as great as the crossmember width, wherein one of the crossmember slots of the at least one crossmember is fitted to each of the plurality of end assemblies at the turn-up space of each of the plurality of end assemblies in a friction-fit manner.

These and other features, objects and advantages of the present invention will become better understood from a consideration of the following detailed description of the preferred embodiments and appended claims in conjunction with the drawings as described following. Such drawings also illustrate an ornamental design of a stacking rack.

DETAILED DESCRIPTION OF THE PREFERRED EMBODIMENT(S)

Figure 1A:
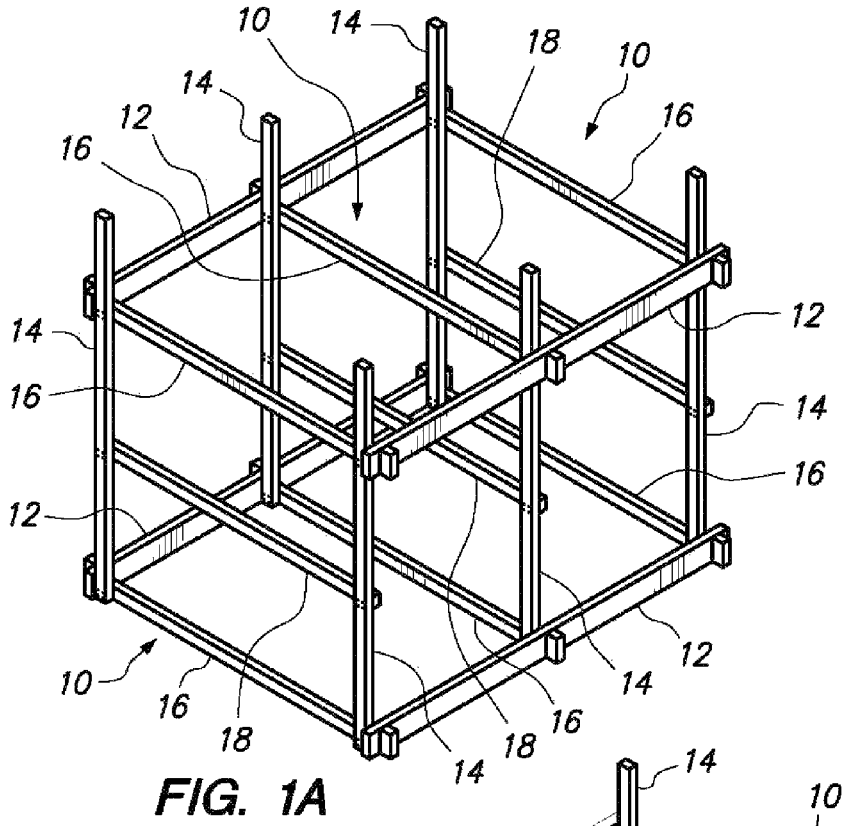
FIGS. 1A and 1B are perspectives view of a rack according to a preferred embodiment of the present invention without the optional roof, FIG. 1A showing the preferred embodiment as assembled, and FIG. 1B showing the preferred embodiment partially disassembled.
Figure 1B:
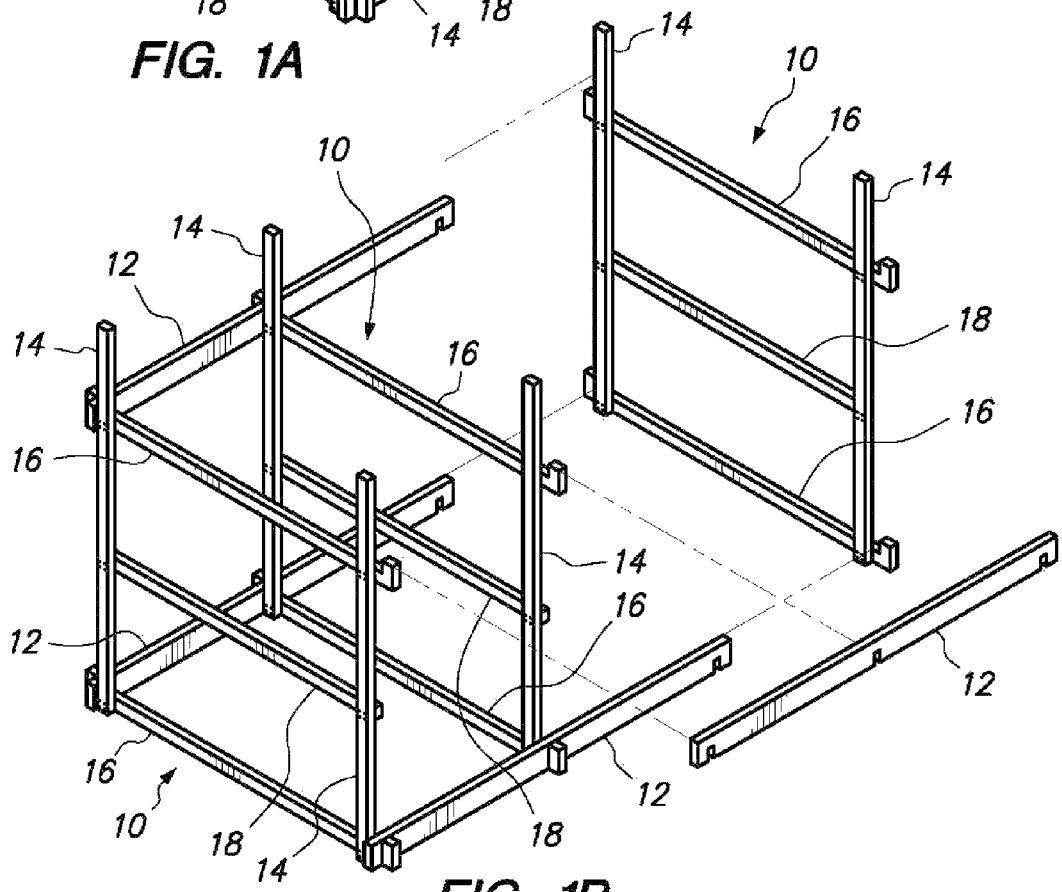
Figure 2:
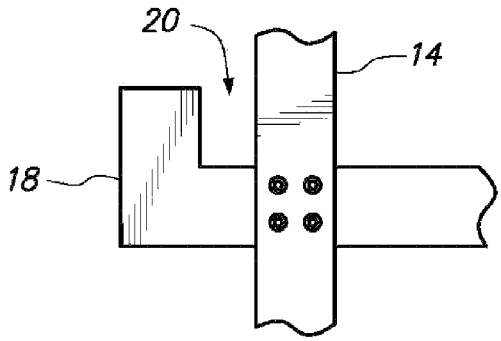
FIG. 2 is a close-up of a slot on an end assembly according to a preferred embodiment of the present invention.
Figure 3:
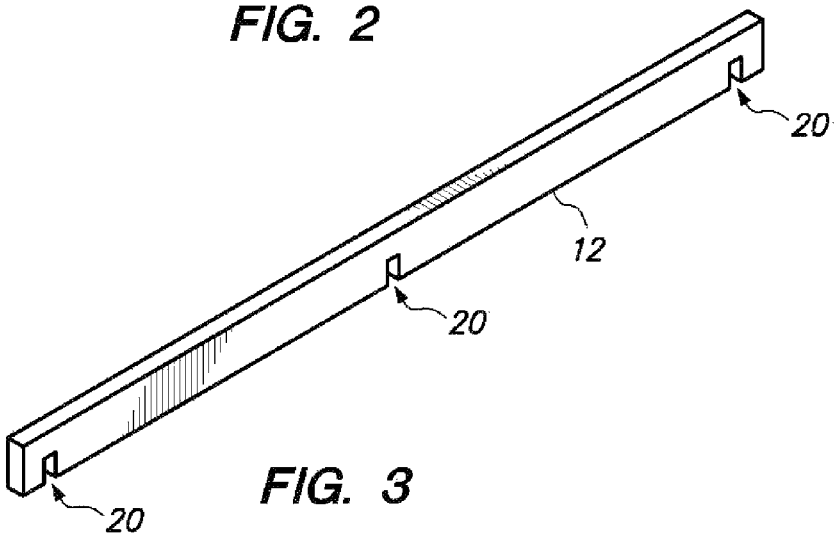
FIG. 3 is a crossmember according to a preferred embodiment of the present invention.

With reference to FIGS. 1-3, the main body of the preferred embodiment of the present invention may be described. The preferred embodiment employs at least two end assemblies 10 in conjunction with at least two crossmembers 12. The crossmembers 12 are aligned in a transverse manner with respect to end assemblies 10, as shown in FIG. 1. The various parts of the end assemblies 10 as will be described may be permanently fastened together in various ways as are known in the art, such as by welding or by screws or bolts. Crossmembers 12 fit to end assemblies 10 by means of a friction fit, for ease of assembly and disassembly. These various parts may be constructed of any sufficiently strong material, such as steel or aluminum, but in the preferred embodiment 14-gauge structural tube steel is used, formed of hollow rectangular beams with dimensions of 1½"×3". A coating such as polyester powder, non-TGIC is preferred to protect the various parts from corrosion.

End assemblies 10 are formed of two vertical members 14 and at least two horizontal turn-up members 16. One or more horizontal straight members 18 may also be included. As shown in FIG. 1, horizontal turn-up members 16 have right-angle turn-ups welded or otherwise attached at either end, which extend slightly out from the outside edges of vertical members 14 at the attachment point. This arrangement is shown most clearly in FIG. 2. The distance from the inner edge of the turn-up on horizontal turn-up members 16 to the outer edge of vertical member 14 is the width of crossmember 12, in order to accommodate a friction lock for crossmember 12 as will be explained following. In certain configurations, no horizontal straight members 18 may be needed. In other configurations, one or more horizontal straight members 18 may be included for increased structural strength of end assemblies 10. As shown in FIG. 1, horizontal straight members 18 preferably do not extend beyond vertical members 14, but instead connect at vertical members 14 with their ends abutting the outside edge of vertical members 14. The rack may use end assemblies 10 of various sizes, but in the preferred embodiment side assemblies 10 are roughly 6' in width and 8' in height.

Horizontal crossmembers 12 are designed with at least two crossmember slots 20 formed in them, as shown in FIG. 3. Crossmember slots 20 are sized to form a friction-fit connection with the space between the turn-ups on horizontal turn-up members 16 of end assemblies 10, with crossmembers 12 positioned transversely to end assemblies 10. This construction is shown most clearly in FIG. 1. A crossmember 12 is positioned at both the front and back of each end assembly 10, resulting in a box frame-like construction that is free standing. It may be understood that by assembling the preferred embodiment in this manner, a simple friction fit is all that is needed to form a secure and strong rack construction, since the force of gravity upon crossmember 12 will hold it firmly in place. Although crossmembers 12 should have at least two crossmember slots 20 so that end assemblies 10 may be placed at either end of the device, more crossmember slots 20 may be provided so that additional end assemblies 10 may be fitted at intervals within the frame of the device to provide additional strength. As shown in FIGS. 1 and 3, a third end assembly 10 is fitted in the center of the construction. It may be seen that by using interchangeable crossmembers 12 of varying lengths with various numbers of crossmember slots 20, the length of the resulting rack may be easily varied to accommodate different types, sizes, and weights of materials. The crossmember slots 20 are preferably maintained, however, at regular intervals for purposes of standardization. In the preferred embodiment, crossmember slots 20 are formed such that they are approximately 4' apart.

Figure 4:
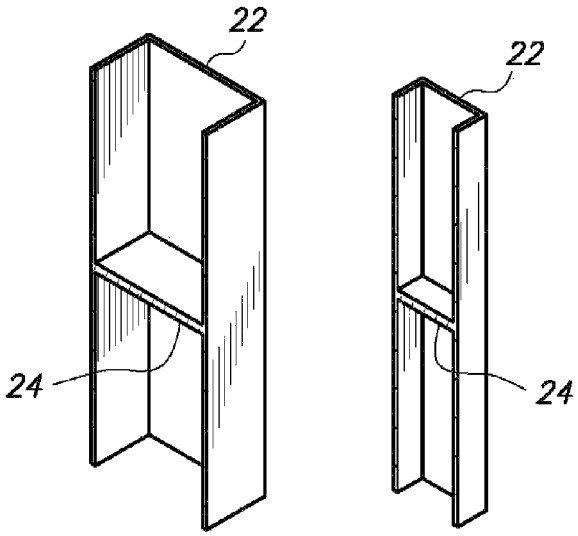
FIG. 4 is a truss sleeve (two elevational views) according to a preferred embodiment of the present invention.

Although in certain embodiments the invention may not include a roof, it may be desirable in some applications to provide a roof that will protect the materials on the rack from rain, sun, or the like. Although various types of roof designs are possible within the scope of the invention, two are illustrated here, being a gable-roof design and a straight-slope roof design. In either case, the roof is fitted to side assemblies 10 of the device by means of truss sleeve 22, as shown in FIG. 4. Truss sleeve 22 is sized so that it may be fitted over the top of vertical members 14 of side assemblies 10. Truss sleeve stop 24 is preferably a flat piece of material that divides truss sleeve 22, preventing vertical member 14 from entering truss sleeve 22 past truss sleeve stop 24. Alternatively, truss sleeve stop 24 could be bumps or a raised groove on the interior of truss sleeve 22; a bolt passing through truss sleeve 22, or other means to block passage of vertical member 14 through truss sleeve 22.

Figure 5:
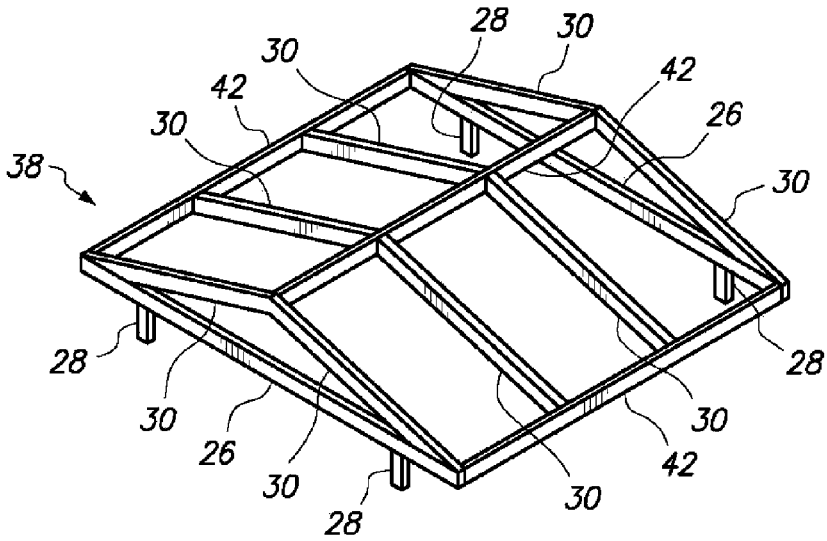
FIG. 5 is a perspective view of a gable truss roof assembly according to a preferred embodiment of the present invention.

Turning to FIG. 5, the construction of a gable-roof arrangement for the preferred embodiment may be described. The roof is constructed with a series of gable truss assemblies 38, each of which will attach to an end assembly 10. Attached at each horizontal truss member 26 are vertical truss members 28. Vertical truss members 28 are positioned and aligned such that they will be co-axial with vertical member 14 of the corresponding end assembly 10 when the truss is fitted into place. Vertical truss members 28 fit into the top half of each truss sleeve 22, and are prevented from over travel within truss sleeve 22 by truss sleeve stop 24. It may be seen then that truss sleeve 22 holds each truss in place in connection with the corresponding end assembly 10. No permanent connection or connecting hardware is required, since the force of gravity on the truss holds vertical truss members 28 securely in place within the corresponding truss sleeves 22. The gable shape of the roof is created by the meeting of diagonal gable truss members 30 at a point above the center of horizontal truss member 26. As with the components of end assemblies 10, the various components of gable truss assemblies 38 may be welded, bolted, screwed together, or otherwise attached together in a permanent fashion. A number of gable truss assemblies 38 will be required matching the number of end assemblies 10 that are employed in a particular configuration of the device.

Truss crossmembers 42 are fitted across gable truss assemblies 38 to hold them together with respect to each other. In the preferred embodiment, three truss crossmembers 42 are employed, one at the apex of the gable roof and one each at the ends of the gable. The length of truss crossmembers 42 is preferably matched to the lengths of crossmembers 12 employed on the rack. Like crossmembers 12, different lengths of truss crossmembers 42 may be used in order to allow for varying configurations of the device. In the preferred embodiment, truss crossmembers 42 are connected to truss assemblies 38 by means of lathe screws. In this manner, the roof may be lifted off as a single piece of desired for quick transport, or the screws may be removed in order to fully breakdown the roof into gable truss assemblies 38 and truss crossmembers 42. Corrosive-resistant #34 lathe screws are employed in the preferred embodiment, with three screws at each connection joint, top and bottom, for a solid, secure connection.

Figure 7:
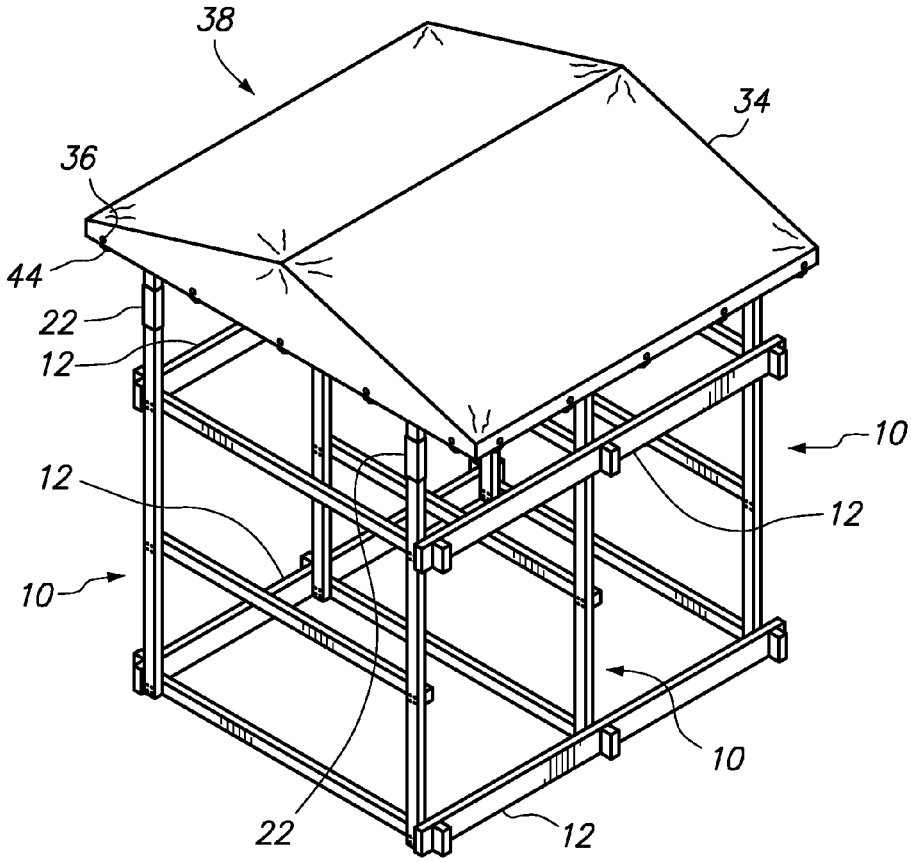
FIG. 7 is a perspective view of a rack with optional gable truss assembly fitted with a canvas roof according to a preferred embodiment of the present invention.

A fabric roof 34 may be stretched across the completed roof, as shown in FIG. 7. Roof 34 may be constructed of any pliable and sufficiently strong material, such as canvas or heavier grades of plastic. Eyelets 36 are spaced periodically along the length of the edges of roof 34 in order to engage with hooks 44 on the device, thereby holding roof 34 in place in a taut fashion. In a preferred embodiment, five eyelets 36 are employed along each side of roof 34, sewn into doubled fabric, with an interior diameter of ½". Further in a preferred embodiment, hooks 44 are 1½" double hook springs, which connect between eyelets 36 and holes drilled into truss crossmembers 42, preferably at the underside of truss crossmembers 42.

Figure 6:
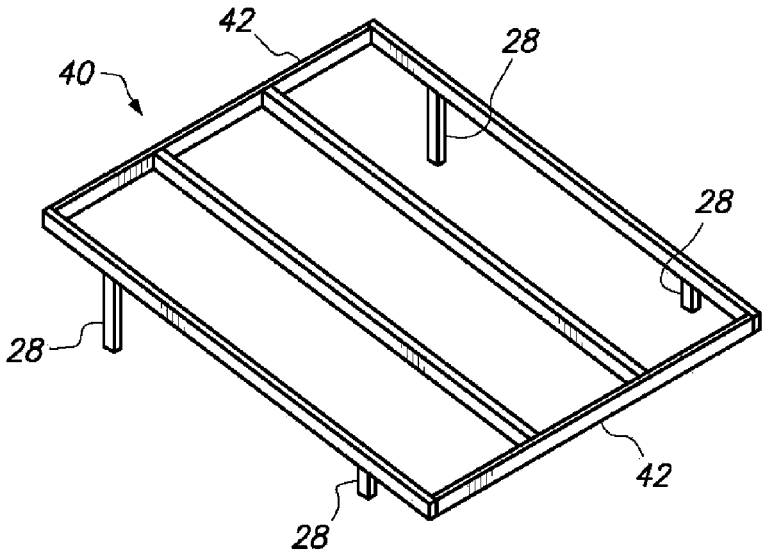
FIG. 6 is a perspective view of a slant truss roof assembly according to a preferred embodiment of the present invention.

Referring now to FIG. 6, an alternative roof design is shown using slant truss assemblies 40 in place of gable truss assemblies 38. The design here is generally similar to that described above, except that the roof runs at a single angle rather than reaching an apex at the point of the gable. While the gable roof may provide superior protection and resistance to weather, such as snow and ice build-up, the single slope roof design uses less material, and is therefore lighter and less expensive to construct.

The modular nature of the preferred embodiment of the invention will be seen as highly advantageous in the construction, storage, and transportation of the device. Since each of the individual components are sized such that they may be transported by two men, no larger crew is required to break down, move, and reassemble the device wherever needed. Likewise, the space required to store the device when not in use is correspondingly small. These advantages are particularly important for construction crews, since racks are often required to store building materials at construction sites, and the racks must necessarily be transported from place to place and periodically placed in storage as one construction job ends and another begins. The preferred embodiment would also be ideal for residential use, since a team of workers is not required to set up or move the rack, and supply companies may also benefit from the preferred embodiment due to the ability to easily accommodate long items of various sizes and weights.

Although in the preferred embodiment described herein the invention is well adapted to the storage of long items, such as pipe, tubing, lumber, and ladders, the device could be simply modified within the scope of the invention to accommodate smaller items. This may be accomplished, for example, by placing flat shelves across the space between opposing crossmembers 12. In addition, the device could be modified by adjusting the spacing between crossmember slots 20; the spacing could be widened to accommodate longer items or to include fewer end assemblies 10, or the spacing could be narrowed in order to provide greater strength for supporting exceptionally heavy items.

The exposed ends of the various components of the rack may be sealed to prevent corrosion due to the entry of rain or moisture. This sealing may be accomplished, for example, by welding a plate sized to the cross-section of the component to the exposed ends of the component. The use of 14-gauge sheet-metal is a preferred approach to sealing. If solid-material components are used rather than hollow-material components, no such sealing is necessary. Truss sleeve 22 may be modified such that its upper portion is removed, resulting in a cap that may be placed on vertical members 14 to protect from the entry of rain or moisture.

As used herein, "comprising" is synonymous with "including," "containing," or "characterized by," and is inclusive or open-ended and does not exclude additional, unrecited elements or method steps. As used herein, "consisting of" excludes any element, step, or ingredients not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements. The invention illustratively described herein suitably may be practiced in the absence of any element or elements, limitation or limitations which is not specifically disclosed herein.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Thus, additional embodiments are within the scope of the invention and within the following claims.

In general the terms and phrases used herein have their art-recognized meaning, which can be found by reference to standard texts, journal references and contexts known to those skilled in the art. The preceding definitions are provided to clarify their specific use in the context of the invention.

All patents and publications mentioned in the specification are indicative of the levels of skill of those skilled in the art to which the invention pertains. All references cited herein are hereby incorporated by reference to the extent that there is no inconsistency with the disclosure of this specification.

The present invention has been described with reference to certain preferred and alternative embodiments that are intended to be exemplary only and not limiting to the full scope of the present invention as set forth in the appended claims.

The invention claimed is:

1. A collapsible stacking rack, comprising:

a. a plurality of end assemblies, wherein each of the plurality of end assemblies are arranged in a parallel fashion with respect to each other, and wherein each of the plurality of end assemblies comprises a plurality of vertical members and at least one horizontal turn-up member, wherein each of the plurality of vertical members are arranged parallel to each other, and the at least one turn-up member is rigidly attached to the plurality of vertical members and lies perpendicularly to each of the plurality of vertical members;

b. at least one crossmember comprising a width, wherein the crossmember is positioned transverse to the plurality of end assemblies and the at least one crossmember comprises a plurality of crossmember slots;

c. a plurality of truss assemblies wherein each of the plurality of truss assemblies is positioned above and removably connected to one of the end assemblies; and d. a plurality of truss sleeves, wherein each of the plurality of truss assemblies comprises a plurality of vertical truss members, wherein each of the plurality of truss sleeves is fitted over an end of one of the plurality of vertical members of the plurality of end assemblies and receives an end of one of the plurality of vertical truss members of the plurality of truss assemblies;

wherein the at least one horizontal turn-up member comprises a turn-up section at an end of the at least one horizontal turn-up member wherein a distance between an outside edge of a nearest one of the plurality of vertical members and an inside edge of the turn-up section at the end of the at least one horizontal turn-up member defines a turn-up space comprising a turn-up space width at least as great as the crossmember width, wherein one of the crossmember slots of the at least one crossmember is fitted to each of the plurality of end assemblies at the turn-up space of each of the plurality of end assemblies in a friction-fit manner.

2. The collapsible stacking rack of claim 1, further comprising a plurality of crossmembers, wherein each horizontal turn-up member comprises a first and second end and at each of the first and second ends the horizontal turn-up member comprises a turn-up section, wherein one of the crossmember slots of one of the plurality of crossmembers is fitted to one of the plurality of end assemblies at the turn-up space at the first end of the horizontal turn-up member in a friction-fit manner, and another of the plurality of crossmembers is fitted to a same one of the plurality of end assemblies at the turn-up space at the second end of the horizontal turn-up member in a friction-fit manner.

3. The collapsible stacking rack of claim 2, wherein each of the plurality of end assemblies further comprises a horizontal straight member rigidly attached transversely to and connecting each of the vertical members of each of the plurality of end assemblies, wherein the horizontal straight member does not extend beyond the outside edge of each of the vertical members.

4. The collapsible stacking rack of claim 2, further comprising at least three end assemblies and wherein each of the crossmembers comprises at least three crossmember slots.

5. The collapsible stacking rack of claim 1, wherein each of the plurality of truss sleeves comprises a stop positioned at an interior surface of each of the plurality of truss sleeves.

6. The collapsible stacking rack of claim 5, further comprising a plurality of truss crossmembers attached perpendicularly to each of the plurality of truss assemblies.

7. The collapsible stacking rack of claim 6, wherein each of the plurality of truss assemblies further comprises a horizontal truss member attached to and perpendicular to each of the plurality of vertical truss members.

8. The collapsible stacking rack of claim 7, further comprising two diagonal truss members attached to the horizontal truss member of each of the plurality of truss assemblies and to each other at an end of each of the two diagonal truss members thereby forming a gable shape of each of the plurality of truss members.

9. The collapsible stacking rack of claim 6, wherein each of the plurality of truss assemblies further comprises a slanted truss member attached to and perpendicular to each of the plurality of truss members.

10. The collapsible stacking rack of claim 6, further comprising a canvas roof attached to and stretched across the plurality of truss assemblies wherein a barrier is formed above the collapsible stacking rack.

11. The collapsible stacking rack of claim 10, wherein the canvas roof comprises an edge comprising a plurality of eyelets, and wherein the canvas roof is attached to the plurality of truss assemblies by means of a plurality of hooks, wherein each of the plurality of hooks is removably attached to the roof at each of the plurality of eyelets and each of the plurality of hooks is removably attached to the plurality of truss assemblies at one of a plurality of attachment holes in each of the plurality of truss assemblies.

* * * * *